US009610486B2

(12) United States Patent
Deggs

(10) Patent No.: US 9,610,486 B2
(45) Date of Patent: Apr. 4, 2017

(54) BATTING AID APPARATUS

(71) Applicant: Matthew Deggs, Huntsville, TX (US)

(72) Inventor: Matthew Deggs, Huntsville, TX (US)

( * ) Notice: Subject to any disclaimer, the term of this patent is extended or adjusted under 35 U.S.C. 154(b) by 0 days.

(21) Appl. No.: 14/627,837

(22) Filed: Feb. 20, 2015

(65) Prior Publication Data

US 2016/0038813 A1 Feb. 11, 2016

Related U.S. Application Data

(60) Provisional application No. 61/942,538, filed on Feb. 20, 2014.

(51) Int. Cl.

| | |
|---|---|
| ***A63B 69/00*** | (2006.01) |
| ***A63B 60/24*** | (2015.01) |
| ***A63B 60/14*** | (2015.01) |
| ***A63B 59/50*** | (2015.01) |

(52) U.S. Cl.

CPC ..... *A63B 69/0002* (2013.01); *A63B 59/50* (2015.10); *A63B 60/14* (2015.10); *A63B 60/24* (2015.10); *A63B 2069/0008* (2013.01)

(58) Field of Classification Search

CPC ..... A63B 69/0002; A63B 2069/0008; A63B 2208/0204

See application file for complete search history.

(56) References Cited

U.S. PATENT DOCUMENTS

| | | | | |
|---|---|---|---|---|
| 2007/0155525 | A1* | 7/2007 | Davenport | A63B 69/3623 473/256 |
| 2013/0172136 | A1* | 7/2013 | Heiberg | A63B 59/0074 473/564 |
| 2014/0171214 | A1* | 6/2014 | Wall, Jr. | A63B 53/10 473/296 |
| 2014/0342854 | A1* | 11/2014 | Thurman | G06Q 30/0621 473/519 |

* cited by examiner

*Primary Examiner* — Gene Kim
*Assistant Examiner* — Jeffrey Vanderveen
(74) *Attorney, Agent, or Firm* — Edmonds & Cmaidalka

(57) ABSTRACT

A batting aid apparatus and methods for using same with a bat (e.g., baseball or softball bat) to increase batting power, bat speed, and swing path is provided. The batting aid apparatus can include an annular body adapted to surround a bat and having a bore formed therethrough, a plurality of annular ribs disposed on a surface of an inner diameter of the annular body and located within the bore of the annular body, and an annular sleeve adjacent and extending from one or more outer surfaces of the annular body, such that the annular sleeve can be concentric with the bore of the annular body.

15 Claims, 5 Drawing Sheets

BATTING AID APPARATUS

CROSS-REFERENCE TO RELATED APPLICATIONS

This application claims benefit of U.S. Provisional Patent Application No. 61/942,538, filed Feb. 20, 2014, which is incorporated herein by reference in its entirety.

BACKGROUND OF THE INVENTION

Field of the Invention

Embodiments described herein generally relate to batting aid apparatus and methods for using same. More particularly, the embodiments generally relate to training devices for use with any kind of bat for improving hitting power, bat speed, and swing path, as well as methods for using same.

BRIEF DESCRIPTION OF THE DRAWINGS

So that the manner in which the above recited features of the embodiments can be understood in detail, a more particular description of the invention, briefly summarized above, may be had by reference to particular embodiments, some of which are illustrated in the appended drawings. It is to be noted, however, that the appended drawings illustrate only typical embodiments and are therefore not to be considered limiting of its scope, for the claimed invention may admit to other equally effective embodiments.

DETAILED DESCRIPTION

Figure 1:
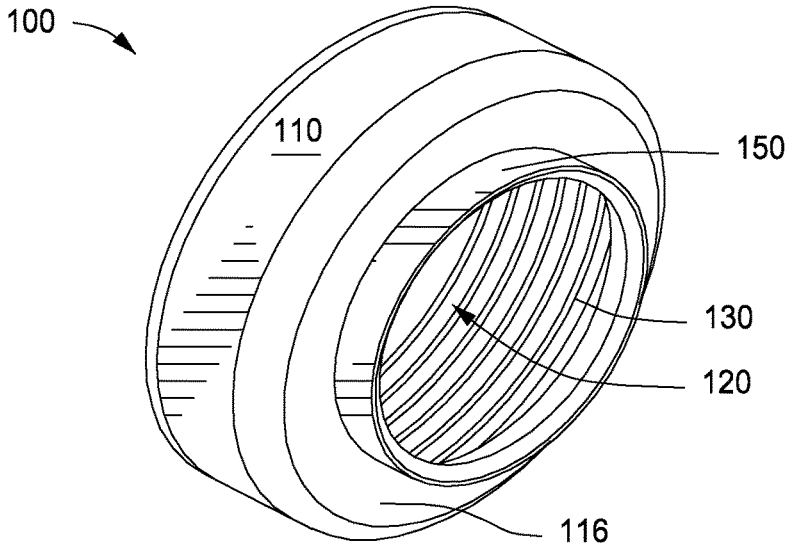
FIG. 1 depicts a perspective view of an illustrative batting aid apparatus, according to one or more embodiments described herein.

FIG. 1 depicts an illustrative perspective view of a batting aid apparatus 100, according to one or more embodiments. The batting aid apparatus 100 can include an annular body 110 having a bore 120 formed therethrough. One or more ribs 130 can be disposed on the inner diameter ($D_2$, depicted in FIG. 4) of the annular body 110 within the bore 120. The one or more ribs 130 can be concentrically aligned within the bore 120. Alternatively, the one or more ribs 130 can be disposed at an angle within the bore 120, but remain parallel to one another. For example, the ribs 130 can angled 5° to 40°, or 5° to 30° from horizontal when the batting aid apparatus 100 is lying flat.

The batting aid apparatus 100 can further include at least one annular extension or sleeve 150 located about the annular body 110 adjacent the front and/or rear outer surfaces 114, 116. The sleeve 150 can be integral with the body 110 or a separate component that is attached or otherwise connected to the body 110. The sleeve 150 can be an annular lip that extends concentrically from the body 110. The sleeve 150 can contact and resist slippage from the bat when the batting aid apparatus 100 is in use. The sleeve 150 can add additional surface area, which increases contact and/or friction to secure and hold the batting aid apparatus 100 in place around a bat when in use.

An inner diameter of the sleeve 150 can be constant from a first end thereof to a second end thereof. The inner diameter of the sleeve 150 can also vary. As discussed below with regard to FIG. 3 in more detail, the inner diameter of the sleeve 150 can taper from one end to the other (i.e. gradually increase or decrease from one end to the other). This taper can be used to provide a tighter fit about the bat when the batting aid apparatus 100 is in use. A ring 153 also can be disposed on the inner surface of the sleeve 150 (as depicted in FIG. 3) and can be used to provide a tighter fit about the bat when the batting aid apparatus 100 is in use.

The batting aid apparatus 100, when in use, can surround, encompass, attach, or otherwise be disposed about a bat for swinging and/or hitting a ball. The batting aid apparatus 100 can be used with any type of bat, batting device, or other sporting equipment that is swung or otherwise moved by an individual, such as a player. Suitable bats, batting devices, or other sporting equipment can include, but are not limited to, bats, sticks, or rackets for baseball, softball, cricket, lacrosse, tennis, and any other sport that involves swinging or otherwise moving a bat to hit, catch, or otherwise make contact with a ball or similar sporting item. Such suitable bats, batting devices, or other sporting equipment can be made from or can contain one or more materials made from wood, metal (e.g., aluminum, titanium, alloys thereof), composite materials (e.g., carbon-based or inorganic materials), plastic or polymeric materials, or other similar materials. For ease of description, however, embodiments of the batting aid apparatus 100 will be further described below with reference to its use on a baseball bat for hitting baseballs.

Figure 2:
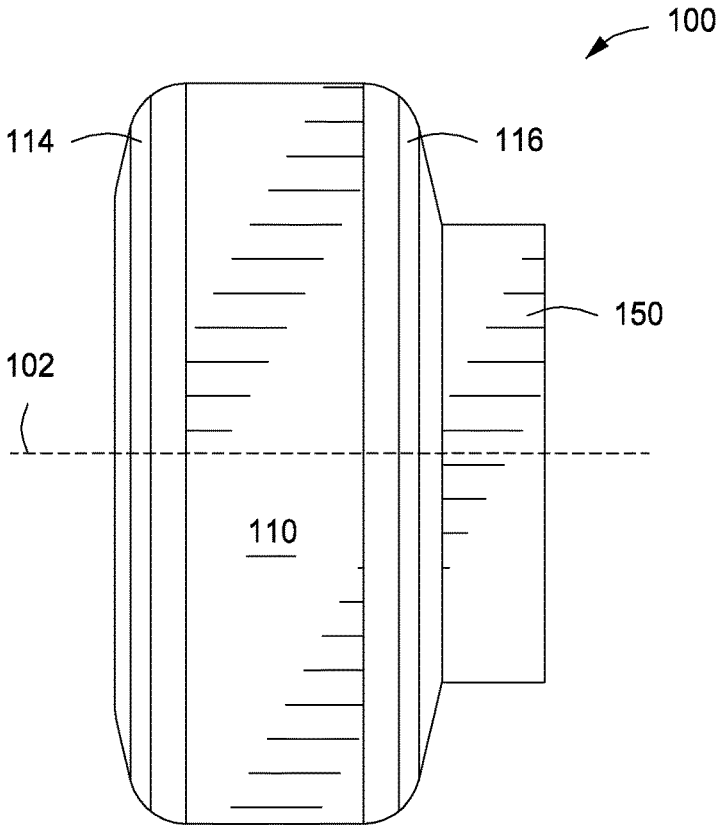
FIG. 2 depicts a side view of the illustrative batting aid apparatus depicted in FIG. 1.
Figure 6:
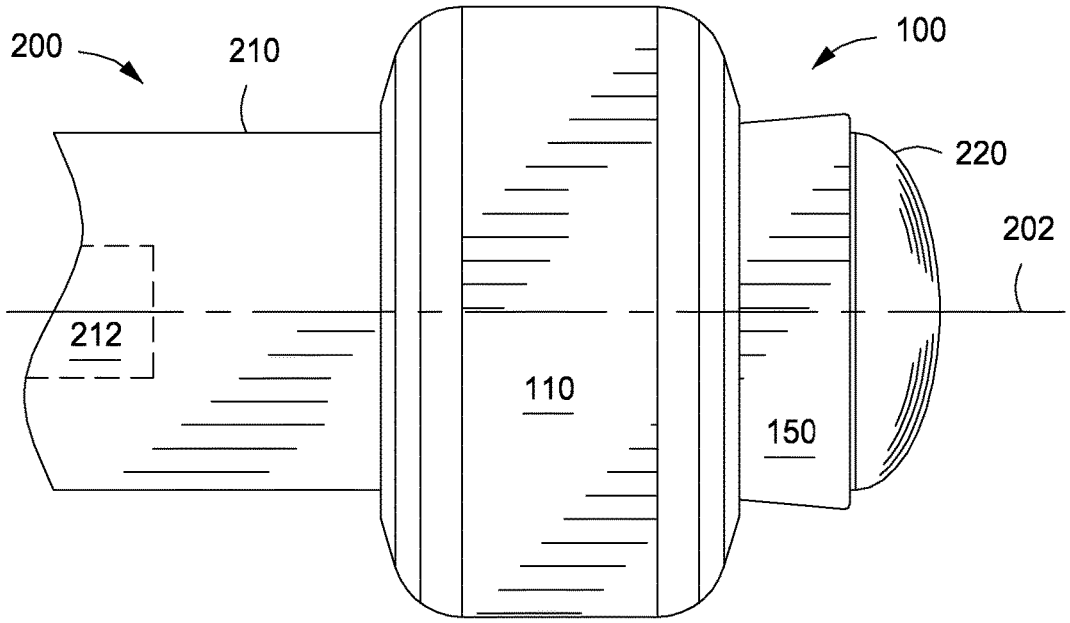
FIG. 6 depicts a side view of the illustrative batting aid apparatus, as illustrated in FIGS. 1-5, positioned on a bat, according to one or more embodiments described herein.
Figure 7:
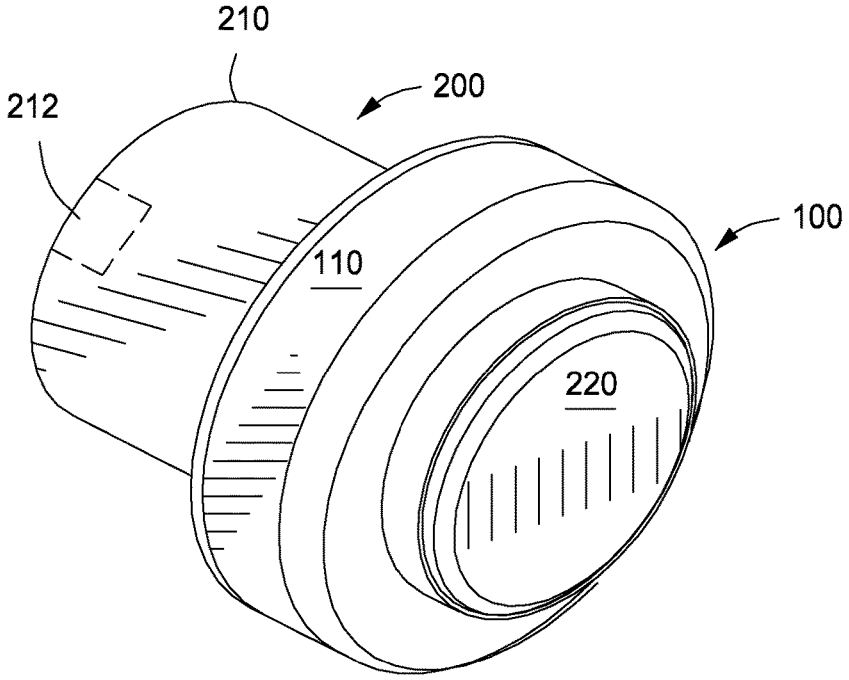
FIG. 7 depicts an angled front view of the illustrative batting aid apparatus positioned on the bat, as depicted in FIG. 6, according to one or more embodiments described herein.

FIG. 2 depicts a side view of the illustrative batting aid apparatus 100 depicted in FIG. 1. As depicted, the annular body 110 has two sides bounded by a first outer surface 114 disposed opposite of a second outer surface 116. When the batting aid apparatus 100 is in use, the bat can be inserted into the bore 130 by entering from the first outer surface 114 via the end cap portion of the bat. Once the batting aid apparatus 100 is disposed on the bat, the end cap of the bat can be protruding out of the second outer surface 116 (as depicted in FIGS. 6 and 7). The additional surface area provided by the annular ribs 130, the sleeve 150, or both the annular ribs 130 and the sleeve 150 can better contact and resist slippage from the bat by increasing friction between the batting aid apparatus 100 and the bat.

Figure 3:
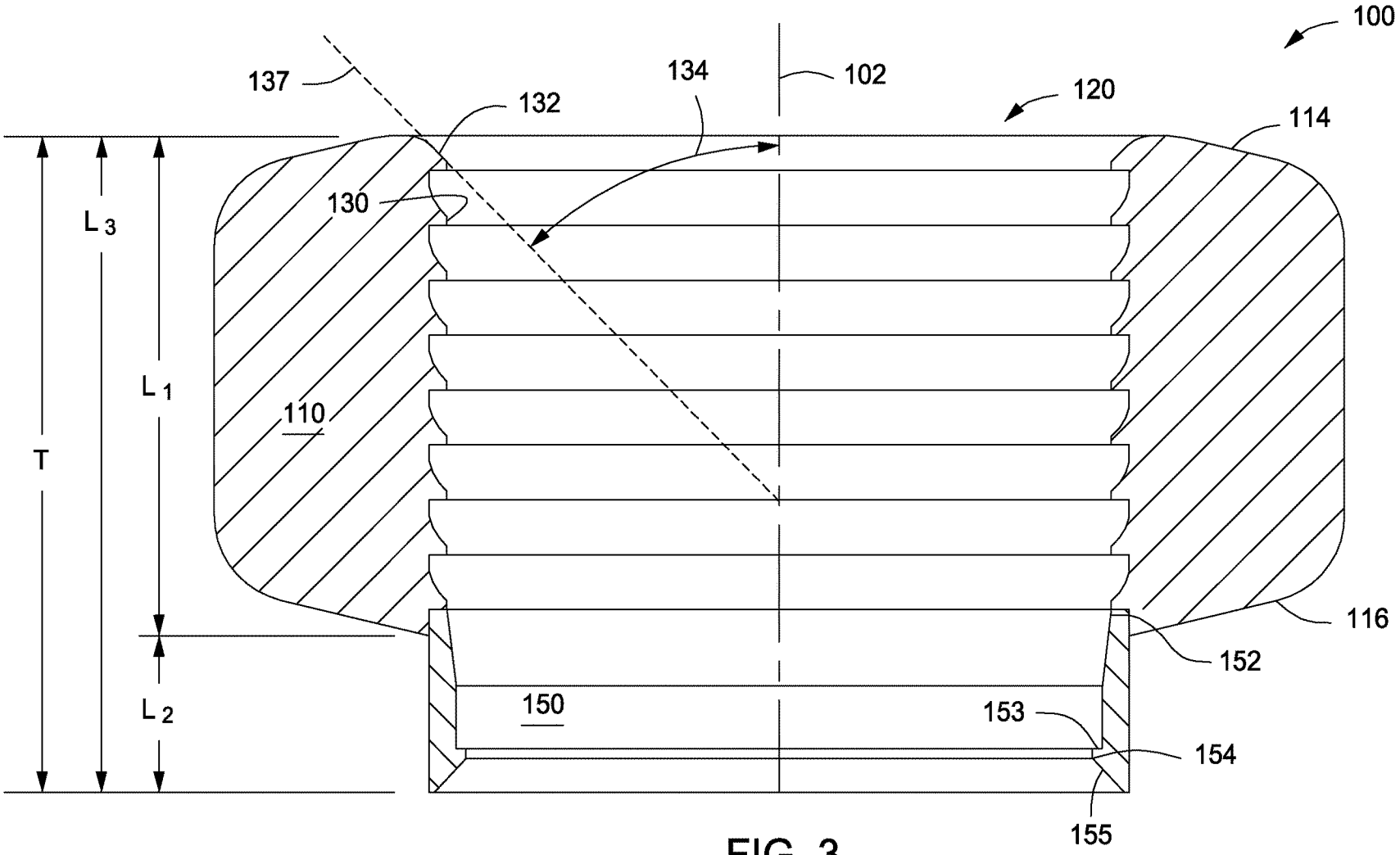
FIG. 3 depicts a cross-section view of the illustrative batting aid apparatus depicted in FIG. 1.

FIG. 3 depicts a cross-section view of the illustrative batting aid apparatus 100 depicted in FIG. 1. As depicted, the annular body 110 can have a height or length ($L_1$), as measured between the front and rear outer surfaces 114, 116. The length ($L_1$) can vary depending on the batting aid apparatus 100. For example, the length ($L_1$) can be about 0.5 inches to about 5 inches, about 0.75 inches to about 4 inches, about 1 inch to about 3 inches, or about 1 inch to about 2 inches. For example, the length ($L_1$) can be about 0.8 inches to about 1.2 inches, about 1.2 inches to about 1.8 inches, about 1.5 inches to about 2.5 inches, or about 2 inches to about 3.8 inches. The sleeve 150 can have a length ($L_2$), as measured from the rear outer surface 116 of the annular body 110 and extending away therefrom, as depicted in FIG. 3. The length ($L_2$) can vary depending on the batting aid apparatus 100. The length ($L_2$) can be about 0.1 inches to about 3 inches, 0.1 inches to about 2 inches, about 0.15 inches to about 1 inch, about 0.2 inches to about 1 inch, about 0.15 inches to about 0.5 inches, or about 0.25 inches to about 0.5 inches, such as, for example, about 0.375 inches. The sum of the lengths ($L_1$) and ($L_2$) can be equal to the overall length ($L_3$) of the bore 120. The length ($L_3$) of the bore 120, as measured along the longitudinal axis 102, can be about 0.5 inches to about 6 inches, about 0.75 inches to about 5 inches, about 1 inch to about 4 inches, about 1.2 inches to about 3.5 inches, or about 1.5 inches to about 3 inches.

The annular ribs 130 can be utilized to contact and resist slippage from a bat, such as by increasing friction between the batting aid apparatus 100 and the bat. The angled surface 132 and the diameter of the annular ribs 130 can be adjusted to desired values for controlling the amount of slippage or friction that is formed between the batting aid apparatus 100 on a particularly sized bat.

Considering the annular ribs 130 in more detail, the annular ribs 130 can have a length or diameter that equals the inner diameter of the body. Alternatively, the ribs 130 can be shorter (i.e. do not touch the sides of the body 110). The ribs 130 can also vary in length (i.e. any number of ribs 130 can extend from side to side, any number of ribs 130 do not, and in any frequency or pattern). For example, each rib 130 can have a length of about 1 inch to about 4 inches, about 1.5 inches to about 3.5 inches, about 2 inches to about 3 inches, or about 2.25 inches to about 2.75 inches.

Each rib 130 can be angled or biased toward one end of the body 110 or the other (114, 116). For example, each rib 130 can be facing away or otherwise angled away from the sleeve 150 and can generally face toward the front outer surface 114, as depicted in FIG. 3. In the alternative, each rib 130 can be facing toward or otherwise angled toward the sleeve 150 and can generally face toward the back outer surface 116. The annular ribs 130 can be positioned or formed such that each annular rib 130 can provide an angled surface 132 having an angle 134 relative to the longitudinal axis 102 of the annular body 110 (i.e. the vertical when the batting aid apparatus 100 is lying down flat). The angle 134 is formed between the longitudinal axis 102 of the body 110, and line 137 that depicts the plane of the angled surface 132. In some examples, the angle 134 can be greater than 0° and less than 90°, such as about 15° to about 75°, about 25° to about 65°, about 35° to about 55°, about 40° to about 50°, about 42° to about 48°, about 44° to about 46°, or about 45°.

The batting aid apparatus 100 depicted in FIGS. 1-3 has 9 annular ribs 130, but any number of ribs 130 can be used. For example, the batting aid apparatus 100 can have anywhere from 2 to about 30 ribs, 2 to about 25 ribs, 2 to about 20 ribs, 3 to about 25 ribs, 3 to about 20 ribs, 3 to about 15 ribs, 3 to about 12 ribs, 3 to about 10 ribs, 3 to about 9 ribs, 4 to about 15 ribs, 4 to about 10 ribs, 5 to about 25 ribs, 5 to about 20 ribs, 5 to about 15 ribs, 5 to about 12 ribs, 5 to about 10 ribs, or 5 to about 9 ribs. The number of annular ribs 130 can also range from about 2, 5, 6, 7, or 8 to about 10, 15, 20, 25, or 30.

FIG. 3 also depicts a ring 153 that can be disposed on the inner surface of the sleeve 150. In some cases, as depicted in FIG. 3, the sleeve 150 can include a single ring 153. In other configurations, not shown, the sleeve 150 can include two or more rings 153. For example, the sleeve 150 can include from 2 to about 10 rings 153. The one or more rings 153 can be used to provide a tighter fit about the barrel of the bat when the batting aid apparatus 100 is in use. The sleeve 150 can also include an angled side 155. When the batting apparatus 100 is removed from a bat, the angled side 155 can reduce the friction between the bat and the inner surface of the sleeve 150 due to having less contact between the bat and the sleeve 150 at the end of the sleeve 150. This reduction of friction provides an easier removal of the bat without folding or otherwise damaging the sleeve 150 i.e. pulling the sleeve 150 into the bore 120.

Figure 4:
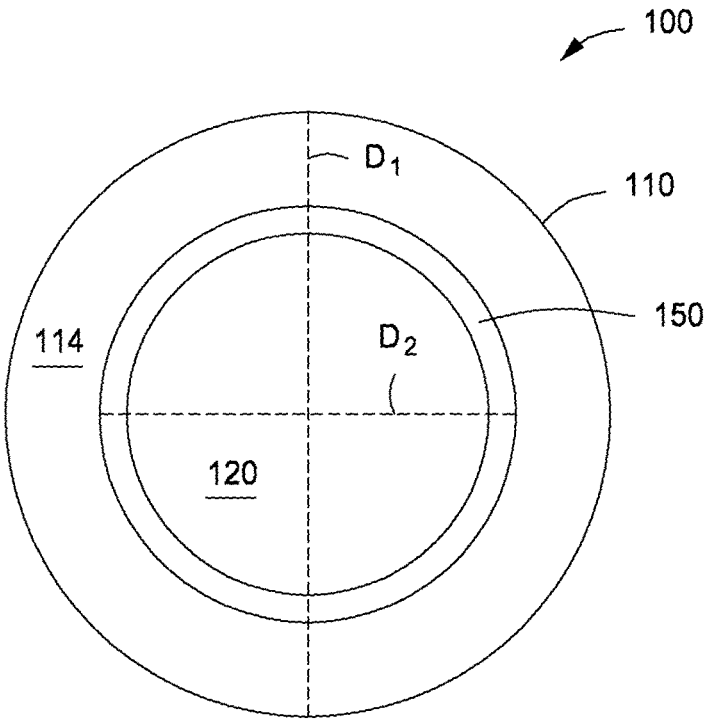
FIG. 4 depicts a front view of the illustrative batting aid apparatus of FIG. 1.

FIG. 4 depicts an illustrative front view of the batting aid apparatus 100. The annular body 110 can have an outer diameter ($D_1$) and an inner diameter ($D_2$). The outer diameter ($D_1$) can be about 2 inches to about 9 inches, about 3 inches to about 8 inches, about 4 inches to about 7 inches, or about 5 inches to about 6 inches. For example, the outer diameter ($D_1$) can be about 3.2 inches to about 3.6 inches, about 3.5 inches to about 3.9 inches, or about 3.8 inches to about 4.2 inches. The inner diameter ($D_2$) can be about 1 inch to about 4 inches, about 1.5 inches to about 3.5 inches, about 2 inches to about 3 inches, or about 2.25 inches to about 2.75 inches. For example, the inner diameter ($D_2$) can be about 1.5 inches to about 3.2 inches, about 1.8 inches to about 2.5 inches, or about 2 inches to about 2.4 inches.

Figure 5:
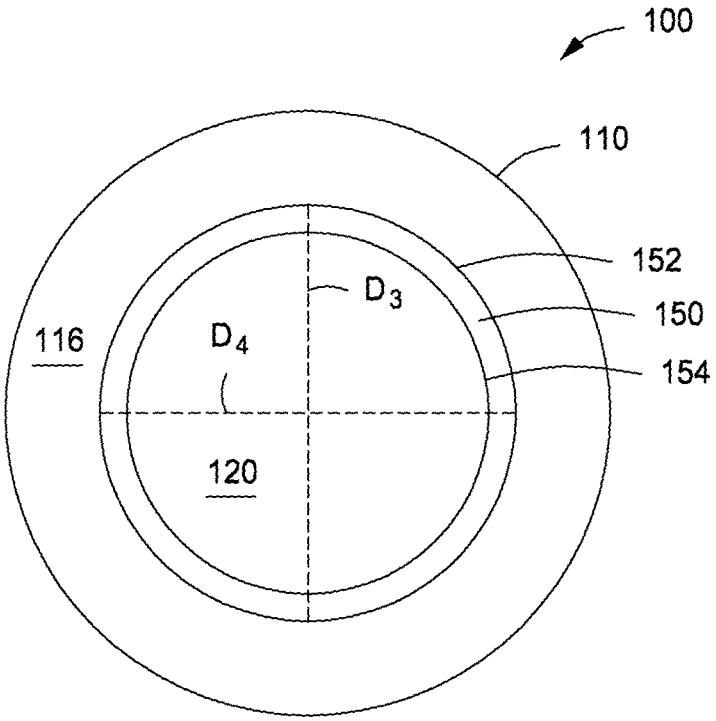
FIG. 5 depicts a rear view of the illustrative batting aid apparatus of FIG. 1.

FIG. 5 depicts a rear view of the illustrative batting aid apparatus of FIG. 1. As depicted, the lip or sleeve 150 can have a first end 152 with a first diameter ($D_3$) and a second end 154 with a second diameter ($D_4$). If the ring 153 is disposed on the inner surface of the sleeve 150, as depicted in FIG. 3, then the ring 153 is the second end 154 and the diameter of the ring 153 is equal to the second diameter ($D_4$). The first end 152 can be adjacent to the rear outer surface 116 and the second end 154, opposite of the first end 152, can be further away from the rear outer surface 116. In some cases, as depicted in FIG. 5, the first diameter ($D_3$) of the first end 152 can be greater than the second diameter ($D_4$) of the second end 154. The first diameter ($D_3$) can also be equal or substantially equal to the second diameter ($D_4$). The second diameter ($D_4$) can also be greater than the first diameter ($D_3$). As such, the inner diameter of the sleeve 150 can taper (i.e. gradually increase or decrease) from one end to the other between the first and second ends 152 and 154. If and when the first diameter ($D_3$) is greater than the second diameter ($D_4$), the inner surface of the sleeve 150 can provide a tighter fit about the bat to better hold or otherwise secure the batting aid apparatus 100 to the bat when in use. Each of the first diameter ($D_3$), the second diameter ($D_4$), and the diameter of the ring 153 can independently be about 1 inch to about 4 inches, about 1.5 inches to about 3.5 inches, or about 2 inches to about 3 inches, or about 2.25 inches to about 2.75 inches. For example, each of the first diameter ($D_3$), the second diameter ($D_4$), and the diameter of the ring 153 can independently be about 1.5 inches to about 3.2 inches, about 1.8 inches to about 2.5 inches, or about 2 inches to about 2.4 inches. The sleeve 150 can have a thickness of about 0.02 inches to about 0.5 inches, about 0.04 inches to about 0.3 inches, or about 0.06 inches to about 0.125 inches.

FIG. 6 depicts a side view and FIG. 7 depicts an angled front view of the batting aid apparatus 100 positioned about a bat 200, according to one or more embodiments. The bat 200 can generally have an end cap 220 at the end of a barrel 210 having sweet-spot 212. The barrel 210 narrows to form a handle (not shown) having a knob (not shown) and optional grip (not shown)—as other portions or parts of a typical bat, such as the bat 200.

The annular body 110 and the sleeve 150 can be adapted to surround a region of the barrel 210 of the bat 200, such as between the sweet-spot 212 and the end cap 220. The annular ribs 130 (within the annular body 110) and the sleeve 150 can be configured or otherwise adapted to contact and resist slippage from the bat 200, such as by increasing friction between the batting aid apparatus 100 and the bat 200. The longitudinal axis 102 of the batting aid apparatus 100 can be aligned with a longitudinal axis 202 of the bat 200, as depicted in FIG. 6. In other examples, the annular body 110 can be adapted to surround a region of the barrel 210 between the sweet-spot 212 on the bat 200 and the end cap 220 of the bat 200.

To assemble the batting aid apparatus 100 onto a bat, the batting aid apparatus 100 can be placed on the ground or other supportive surface or object with the front outer surface 114 facing up. The bat 200 can be inserted into the bore 120, such that the end cap 220 enters the bore 120 from the front outer surface 114. Once the batting aid apparatus 100 is positioned or otherwise disposed on the bat 200, the end cap 220 can protrude from the sleeve 150 (as depicted in FIG. 6) or the end cap 220 can be flush or substantially flush with the outer edge of the sleeve 150 (as depicted in FIG. 7).

Figure 8:
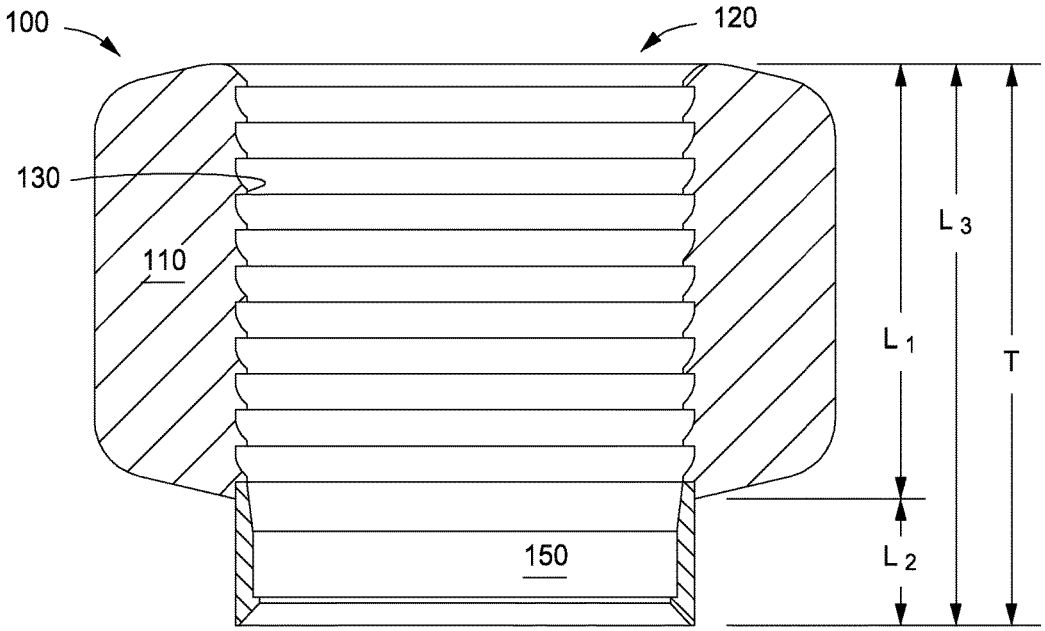
FIG. 8 depicts an illustrative cross-section view of the batting aid apparatus of FIG. 1 having 9 annular ribs, according to one or more embodiments described herein.
Figure 9:
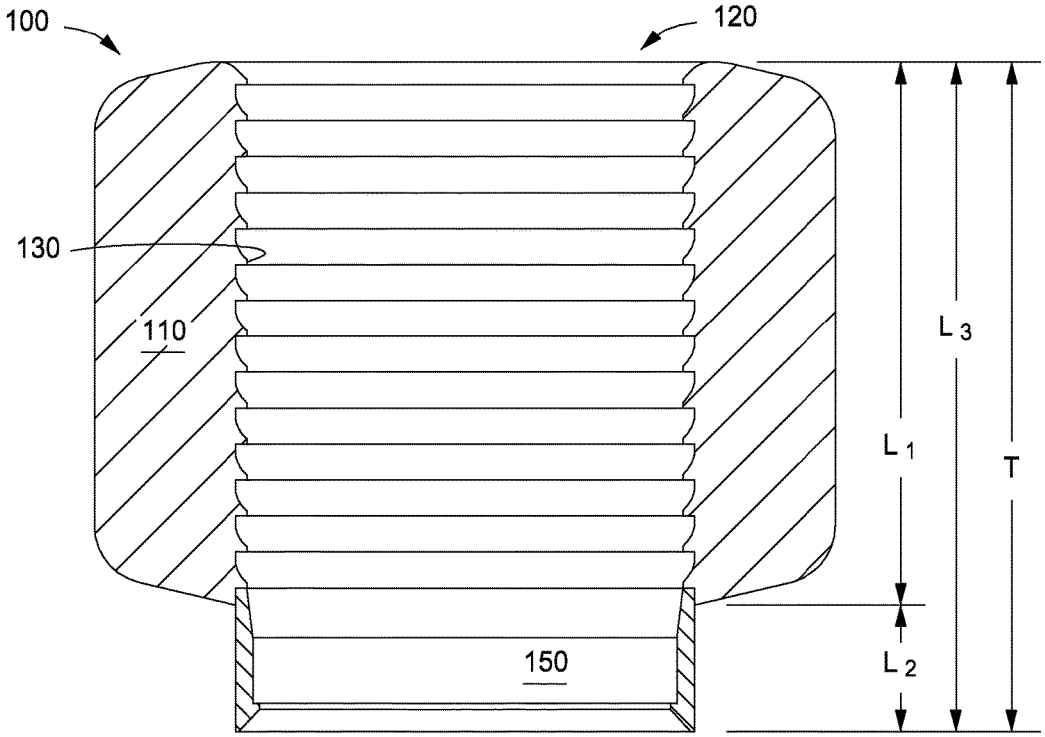
FIG. 9 depicts an illustrative cross-section view of the batting aid apparatus of FIG. 1 having 15 annular ribs, according to one or more embodiments described herein.

FIGS. 8 and 9 depict illustrative cross-section views of the batting aid apparatus 100 with differing number of ribs 130, according to one or more embodiments. As depicted in FIG. 8, the batting aid apparatus 100 can have 9 annular ribs 130 and as depicted in FIG. 9, the batting aid apparatus 100 can have 15, although any number of ribs 130 can be used.

Still referring to FIGS. 8 and 9, the number of ribs 130 necessarily changes the overall dimensions of the batting aid apparatus 100, which can vary depending on the bat for which it is intended to be used. By way of example, the batting aid apparatus 100 having 9 to 15 ribs 130 can have a length ($L_1$) of about 1.2 inches to about 1.8 inches, a length ($L_2$) of about 0.25 inches to about 0.5 inches, and a length ($L_3$) of about 1.5 inches to about 2.25 inches. In another example, the batting aid apparatus 100 having 9 to 15 ribs 130 can have a length ($L_1$) of about 1.5 inches to about 2.5 inches, a length ($L_2$) of about 0.25 inches to about 0.5 inches, and a length ($L_3$) of about 2 inches to about 2.75 inches.

The thickness (T) of the body 110 can also vary depending on the bat for which it is intended to be used. By varying any of the lengths $L_1$, $L_2$ and/or $L_3$ and/or varying the thickness (T) of the body 110, the weight of the batting aid apparatus 100 can be controlled or manipulated to provide optimal resistance. A suitable thickness of the body 100 can range from about 0.125 inches to about 2.5 inches. A suitable thickness of the body 100 can also range from a low of about 0.1, 0.2, 0.5, or 0.75 inches to high of about 1.00, 1.25, 1.75, or 2.0 inches.

The batting aid apparatus 100 can have any suitable mass or weight, depending on the type of bat and the desired amount of mass to be used. For example, the batting aid apparatus 100 can have a mass or weight of about 0.5 ounces to about 12 ounces, about 1 ounce to about 12 ounces, about 2 ounces to about 10 ounces, about 3 ounce to about 10 ounces, about 4 ounces to about 8 ounces, about 4.5 ounces to about 7.5 ounces, or about 5 ounces to about 7 ounces. In some examples, the batting aid apparatus 100 can weigh about 5.2 ounces to about 6.8 ounces, about 5.4 ounces to about 6.7 ounces, about 5.6 ounces to about 6.6 ounces, about 5.8 ounces to about 6.5 ounces, about 5.9 ounces to about 6.4 ounces, about 6.0 ounces to about 6.4 ounces, or about 6.1 ounces to about 6.3 ounces, such as, for example, about 6.3 ounces. The mass or weight of the batting aid apparatus 100 can be tailored by adjusting or modifying the materials used to make the batting aid apparatus 100 or any of it individual components or parts. For example, different rubbers or plastics having different densities can be used until a desired mass of the batting aid apparatus 100 is achieved. And although not shown, one or more additional weights can be attached or otherwise secured to the batting aid apparatus 100 to increase its weight. Such weights could be removable or permanently affixed to an outer surface of the batting aid apparatus 100. Alternatively, two or more batting aid apparatus 100 can be used on the same bat at the same time. And although not shown, one or more fins or flaps can be attached or otherwise secured to an outer surface of the batting aid apparatus 100 (e.g. outer diameter of the body 110 or either end 114, 116) to increase swing resistance when in use. Such fins or flaps could also be removable or permanently affixed to an outer surface of the batting aid apparatus 100.

Any suitable material for making the batting aid apparatus 100 and/or the individual components or parts can be used. Each component part of the batting aid apparatus 100 can be made from the same material(s), or any one or more component part can be made of different material(s). Suitable materials can include, but are not limited to, one or more metals (such as aluminum, steel, stainless steel, brass, nickel), fiberglass, wood, composite materials (such as ceramics, wood/polymer blends, cloth/polymer blends, etc.), and plastics, resins, rubbers, polymeric materials, and/or oligomeric materials (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), and mixtures, blends, or copolymers of any and all of the foregoing materials.

Preferably, the components of the batting aid apparatus 100 can be made from or otherwise include one or more plastics, resins, rubbers, polymeric materials, oligomeric materials, or mixtures thereof. For example, each of the annular ribs 130, the sleeve 150, and/or the sleeve 150 can be independently made from or contain one or more plastics, resins, rubbers, polymeric materials, oligomeric materials, or mixtures thereof. In some examples, the annular body 110, the annular ribs 130, and the sleeve 150 can be made as a single, unitary component. In other examples, the annular body 110, the annular ribs 130, and the sleeve 150 can be made as separate pieces or portions and subsequently combined or otherwise attached to form the batting aid apparatus

100. In other examples, the annular body 110 and the annular ribs 130 can be made as a unitary component, and subsequently combined with the sleeve 150 to form the batting aid apparatus 100. In other examples, the annular body 110 and the sleeve 150 can be made one component, and subsequently combined with the annular ribs 130 (or the annular ribs 130 can be formed within the bore 120) to form the batting aid apparatus 100.

When assembled to a bat:

1.) The batting aid apparatus 100 does not compromise the sweet-spot (e.g., the hitting zone) of the barrel, an individual can use a bat to hit balls while the batting aid apparatus 100 is disposed on the bat.

2.) The batting aid apparatus 100 helps to promote hand strength for an individual and creates the ability for an individual to keep backside above the fast moving ball.

3.) The batting aid apparatus 100 provides the hitter to feel the bat head in the individual's hands so to better deliver the barrel with whip, snap, extension, and/or other hitting characteristic to be improved upon.

4.) The batting aid apparatus 100 promotes bat path by building strength and muscle memory.

5.) The batting aid apparatus 100, by sitting at or near the end cap of the bat and once the bat is swung, helps propel the end cap with whip and snap through extension.

6.) The batting aid apparatus 100 can be used by the individual to partially cover or obscure the end cap of the bat, so to effective "remove" the end cap of the bat (an unfavorable region of the bat to make contact with a ball) and to promote focusing the individual's swing away from the end cap and to the sweet-spot on the barrel of the bat.

7.) The batting aid apparatus 100 provides the individual with increases bat speed, hitting power, and swing path relative to the individual's ability prior to using the batting aid apparatus 100.

The batting aid apparatus 100 can be utilized to decrease the bat drop value of a bat which can help increase hitting power of an individual. Generally, a bat with an increased bat drop value provides greater swing speed and a bat with a decreased bat drop value provides greater batting power. In some embodiments, the batting aid apparatus 100 can be utilized to decrease the bat drop value of a bat by −1, −2, −3, −4, −5, −6, −7, −8, −9, −10, or greater negative bat drop values, so that the same length bat can be used by the individual.

A "bat drop" value is determined by subtracting the bat length (in unit of inches) from the bat weight (in unit of ounces). Examples: A bat having a length of 32 inches and a weight of 30 ounces has a bat drop of −2 (30−32=−2). A bat having a length of 32 inches and a weight of 32 ounces has a bat drop of 0 (32−32=0). A bat having a length of 32 inches and a weight of 33 ounces has a bat drop of +1 (33−32=+1).

Embodiments of the invention further relate to:

1. A batting aid apparatus, comprising: an annular body having a bore formed therethrough, the annular body adapted to surround a bat; a plurality of annular ribs disposed on a surface of an inner diameter of the annular body, the annular ribs located within the bore of the annular body; and an annular sleeve adjacent and extending from an outer surface of the annular body, the annular sleeve is concentric with the bore of the annular body.

2. A batting aid apparatus, comprising: an annular body having a bore formed therethrough, wherein the bore is aligned with a longitudinal axis of the annular body, and the annular body is adapted to surround a bat; a plurality of annular ribs disposed on a surface of an inner diameter of the annular body, the annular ribs located within the bore of the annular body; and an annular sleeve adjacent and extending from an outer surface of the annular body, wherein the annular sleeve is concentric with the bore of the annular body.

3. The apparatus according to paragraph 1, wherein the annular body has a longitudinal axis.

4. The apparatus according to paragraph 2 or 3, wherein the annular ribs are angled relative to the longitudinal axis of the annular body.

5. The apparatus according to paragraph 1 or 2, wherein the annular ribs are facing away from the annular sleeve.

6. The apparatus according to paragraph 2 or 3, wherein the annular ribs have an angle of greater than 0° to less than 90° relative to the longitudinal axis of the annular body.

7. The apparatus according to any one of the paragraphs 1 to 6, wherein the annular ribs have an angle of about 15° to about 75° relative to the longitudinal axis of the annular body.

8. The apparatus according to any one of the paragraphs 1 to 7, wherein the annular ribs have an angle of about 25° to about 65° relative to the longitudinal axis of the annular body.

9. The apparatus according to any one of the paragraphs 1 to 8, wherein the annular ribs have an angle of about 35° to about 55° relative to the longitudinal axis of the annular body.

10. The apparatus according to any one of the paragraphs 1 to 9, wherein each of the annular ribs has an angled surface, and the angled surface is angled relative to the longitudinal axis of the annular body.

11. The apparatus according to any one of the paragraphs 1 to 10, wherein the angled surfaces have an angle of about 15° to about 75° relative to the longitudinal axis of the annular body.

12. The apparatus according to any one of the paragraphs 1 to 11, wherein the angled surfaces have an angle of about 35° to about 55° relative to the longitudinal axis of the annular body.

13. The apparatus of according to any one of the paragraphs 1 to 12, further comprising a mass of about 0.5 ounces to about 12 ounces.

14. The apparatus according to any one of the paragraphs 1 to 13, wherein the mass is about 1 ounce to about 12 ounces.

15. The apparatus according to any one of the paragraphs 1 to 14, wherein the mass is about 2 ounces to about 10 ounces.

16. The apparatus according to any one of the paragraphs 1 to 15, wherein the mass is about 3 ounce to about 10 ounces.

17. The apparatus according to any one of the paragraphs 1 to 16, wherein the mass is about 4 ounces to about 8 ounces.

18. The apparatus according to any one of the paragraphs 1 to 17, wherein the mass is about 5 ounces to about 7 ounces.

19. The apparatus according to any one of the paragraphs 1 to 18, wherein the apparatus is made from one or more plastics, resins, rubbers, polymeric materials, oligomeric materials, or mixtures thereof.

20. The apparatus according to any one of the paragraphs 1 to 19, wherein each of the annular body, the annular ribs, and the annular sleeve independently comprises one or more plastics, resins, rubbers, polymeric materials, oligomeric materials, or mixtures thereof.

21. The apparatus according to any one of the paragraphs 1 to 20, wherein the annular sleeve comprises a flexible material or an elastic material.

22. The apparatus according to any one of the paragraphs 1 to 21, wherein the annular body, the annular ribs, and the annular sleeve are made as a unitary piece.

23. The apparatus according to any one of the paragraphs 1 to 22, wherein the annular body, the annular ribs, and the annular sleeve are made as independent pieces.

24. The apparatus according to any one of the paragraphs 1 to 23, wherein the annular body has a diameter of about 3 inches to about 8 inches.

25. The apparatus according to any one of the paragraphs 1 to 24, wherein the annular body has a diameter of about 4 inches to about 7 inches.

26. The apparatus according to any one of the paragraphs 1 to 25, wherein the annular body has a diameter of about 5 inches to about 6 inches.

27. The apparatus according to any one of the paragraphs 1 to 26, wherein the annular body has a length along the longitudinal axis of about 0.5 inches to about 5 inches.

28. The apparatus according to any one of the paragraphs 1 to 27, wherein the annular body has a length along the longitudinal axis of about 0.75 inches to about 4 inches.

29. The apparatus according to any one of the paragraphs 1 to 28, wherein the annular body has a length along the longitudinal axis of about 1 inch to about 3 inches.

30. The apparatus according to any one of the paragraphs 1 to 29, wherein the bore has a diameter of about 1 inch to about 4 inches.

31. The apparatus according to any one of the paragraphs 1 to 30, wherein the bore has a diameter of about 1.5 inches to about 3.5 inches.

32. The apparatus according to any one of the paragraphs 1 to 31, wherein the bore has a diameter of about 2 inches to about 3 inches.

33. The apparatus according to any one of the paragraphs 1 to 32, wherein the bore has a diameter of about 2.25 inches to about 2.75 inches.

34. The apparatus according to any one of the paragraphs 1 to 33, wherein the bore has a length along the longitudinal axis of about 0.5 inches to about 6 inches.

35. The apparatus according to any one of the paragraphs 1 to 34, wherein the bore has a length along the longitudinal axis of about 0.75 inches to about 5 inches.

36. The apparatus according to any one of the paragraphs 1 to 35, wherein the bore has a length along the longitudinal axis of about 1 inch to about 4 inches.

37. The apparatus according to any one of the paragraphs 1 to 36, wherein the plurality of annular ribs comprises 2 annular ribs to about 20 annular ribs.

38. The apparatus according to any one of the paragraphs 1 to 37, wherein the plurality of annular ribs comprises 2 annular ribs to about 10 annular ribs.

39. The apparatus according to any one of the paragraphs 1 to 38, wherein the plurality of annular ribs comprises 3 annular ribs to about 8 annular ribs.

40. The apparatus according to any one of the paragraphs 1 to 39, wherein the plurality of annular ribs comprises 4 annular ribs to about 10 annular ribs.

41. The apparatus according to any one of the paragraphs 1 to 40, wherein the inner diameter of the annular body is about 1 inch to about 4 inches.

42. The apparatus according to any one of the paragraphs 1 to 41, wherein the inner diameter of the annular body is about 1.5 inches to about 3.5 inches.

43. The apparatus according to any one of the paragraphs 1 to 42, wherein the inner diameter of the annular body is about 2 inches to about 3 inches.

44. The apparatus according to any one of the paragraphs 1 to 43, wherein the inner diameter of the annular body is about 2.25 inches to about 2.75 inches.

45. The apparatus according to any one of the paragraphs 1 to 44, wherein the annular sleeve has a first end with a first diameter adjacent to the outer surface of the annular body and a second end with a second diameter opposite of the first end.

46. The apparatus according to any one of the paragraphs 1 to 45, wherein the first diameter is greater than the second diameter.

47. The apparatus according to any one of the paragraphs 1 to 46, wherein each of the first diameter and the second diameter is independently about 1 inch to about 4 inches.

48. The apparatus according to any one of the paragraphs 1 to 47, wherein each of the first diameter and the second diameter is independently about 1.5 inches to about 3.5 inches.

49. The apparatus according to any one of the paragraphs 1 to 48, wherein each of the first diameter and the second diameter is independently about 2 inches to about 3 inches.

50. The apparatus according to any one of the paragraphs 1 to 49, wherein each of the first diameter and the second diameter is independently about 2.25 inches to about 2.75 inches.

51. The apparatus according to any one of the paragraphs 1 to 50, wherein the annular sleeve has a length from outer surface of the annular body of about 0.1 inches to about 2 inches.

52. The apparatus according to any one of the paragraphs 1 to 51, wherein the annular sleeve has a length from outer surface of the annular body of about 0.2 inches to about 1 inch.

53. The apparatus according to any one of the paragraphs 1 to 52, wherein the annular sleeve has a length from outer surface of the annular body of about 0.25 inches to about 0.5 inches.

54. The apparatus according to any one of the paragraphs 1 to 53, wherein the annular sleeve has a length from outer surface of the annular body of about 0.375 inches.

55. The apparatus according to any one of the paragraphs 1 to 54, wherein the annular sleeve has a thickness of about 0.02 inches to about 0.5 inches.

56. The apparatus according to any one of the paragraphs 1 to 55, wherein the annular sleeve has a length from outer surface of the annular body of about 0.04 inches to about 0.3 inches.

57. The apparatus according to any one of the paragraphs 1 to 56, wherein the annular sleeve has a length from outer surface of the annular body of about 0.06 inches to about 0.125 inches.

58. The apparatus according to any one of the paragraphs 1 to 57, wherein the annular ribs, the annular sleeve, or both of the annular ribs and the annular sleeve are adapted to contact the bat and resist slippage from the bat.

59. The apparatus according to any one of the paragraphs 1 to 58, wherein the annular ribs, the annular sleeve, or both of the annular ribs and the annular sleeve are adapted to contact the bat and increase friction between the apparatus and the bat.

60. The apparatus according to any one of the paragraphs 1 to 59, wherein the annular body is adapted to surround a barrel region of the bat.

61. The apparatus according to any one of the paragraphs 1 to 60, wherein the annular body is adapted to surround the barrel region between the sweet-spot on the bat and the end cap of the bat.

62. The apparatus according to any one of the paragraphs 1 to 61, wherein the batting aid apparatus has a mass of about 0.5 ounces to about 12 ounces.

63. The apparatus according to any one of the paragraphs 1 to 62, wherein the batting aid apparatus has a mass of about 1 ounce to about 12 ounces.

64. The apparatus according to any one of the paragraphs 1 to 63, wherein the batting aid apparatus has a mass of about 2 ounces to about 10 ounces.

65. The apparatus according to any one of the paragraphs 1 to 64, wherein the batting aid apparatus has a mass of about 4 ounces to about 8 ounces.

66. The apparatus according to any one of the paragraphs 1 to 65, wherein the batting aid apparatus has a mass of about 4.5 ounces to about 7.5 ounces.

67. The apparatus according to any one of the paragraphs 1 to 66, wherein the batting aid apparatus has a mass of about 5 ounces to about 7 ounces.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. And if applicable, all patents, test procedures, and other documents cited in this application are fully incorporated by reference to the extent such disclosure is not inconsistent with this application and for all jurisdictions in which such incorporation is permitted.

While the foregoing is directed to certain illustrative embodiments, other and further embodiments of the invention can be devised without departing from the basic scope thereof, and the scope thereof is determined by the claims that follow.

What is claimed is:

1. A batting aid apparatus, comprising:

a cylindrical body having an outer diameter and a bore formed therethrough, the cylindrical body adapted to surround a barrel of a bat;

a plurality of annular ribs disposed on an inner diameter of the cylindrical body, wherein the annular ribs project into the bore of the cylindrical body and are all angled in a single direction toward one end of the bore; and an annular sleeve extending laterally out from one end of the cylindrical body and extending away from the one end of the cylindrical body, the annular sleeve concentric with the bore of the cylindrical body and wherein the annular sleeve has an outer diameter that is less than the outer diameter of the cylindrical body, forming a sloped shoulder therebetween;

wherein the annular ribs are angled at about 25 degrees to about 65 degrees relative to a longitudinal axis of the cylindrical body.

2. The batting aid apparatus of claim 1, wherein the bore is aligned with a longitudinal axis of the cylindrical body.

3. The batting aid apparatus of claim 1, wherein the plurality of annular ribs comprises 2 annular ribs to about 25 annular ribs.

4. The batting aid apparatus of claim 1, wherein the plurality of annular ribs comprises 3 annular ribs to about 20 annular ribs.

5. The batting aid apparatus of claim 1, wherein each of the cylindrical body, the annular ribs, and the annular sleeve independently comprises one or more plastics, resins, rubbers, polymeric materials, oligomeric materials, or mixtures thereof.

6. The batting aid apparatus of claim 1, wherein the cylindrical body, the annular ribs, and the annular sleeve are made as a unitary piece.

7. The batting aid apparatus of claim 1, wherein the cylindrical body, the annular ribs, and the annular sleeve are made as independent pieces.

8. The batting aid apparatus of claim 1, wherein the annular sleeve has a first end with a first inner diameter disposed adjacent to the end of the cylindrical body and the annular sleeve has a second end with a second inner diameter opposite of the first end, and wherein the first inner diameter of the annular sleeve is greater than the second inner diameter of the annular sleeve forming a tapered inner surface therebetween.

9. The batting aid apparatus of claim 8, wherein the first inner diameter of the annular sleeve is about 2.25 inches to about 2.75 inches.

10. The batting aid apparatus of claim 1, wherein the annular sleeve has a length of about 0.1 inches to about 2 inches.

11. A batting aid apparatus for hitting baseballs, comprising:

a cylindrical body having a longitudinal bore formed therethrough;

a plurality of annular ribs disposed on an inner diameter of the cylindrical body, wherein the annular ribs project into the bore of the cylindrical body and are all angled in a single direction toward one end of the bore; and an extension connected to a second end of the cylindrical body, the extension is adjacent the cylindrical body and extends laterally out from the cylindrical body therefrom and has a bore formed therethrough that is concentric with the bore of the cylindrical body, wherein the extension has an outer diameter that is less than an outer diameter of the cylindrical body, forming a sloped shoulder therebetween, and wherein the cylindrical body is adapted to surround a barrel portion of a bat, adjacent a hitting zone of the bat, and the cylindrical body has an inner diameter corresponding to an outer diameter of the barrel to provide a friction fit therebetween, the friction fit enhanced by additional surface area provided by the plurality of angled, annular ribs disposed within the bore of the cylindrical body;

wherein the angle of inclination for each rib is from about 25 degrees to about 65 degrees.

12. The apparatus of claim 11, wherein the extension has a first end connected to the cylindrical body and a second end that is open, the second end having a thickness that tapers.

13. A batting aid apparatus for hitting baseballs, comprising:

a cylindrical body having a longitudinal bore formed therethrough;

a plurality of annular ribs disposed on an inner diameter of the cylindrical body, wherein the annular ribs project into the bore of the cylindrical body and are all angled in a single direction toward one end of the bore, the angle of inclination for each rib is from about 25 degrees to about 65 degrees; and an extension connected to a second end of the cylindrical body, the extension is adjacent the cylindrical body extending out from the cylindrical body and has a bore formed therethrough that is concentric with the bore of the cylindrical body, the extension has a first end connected to the cylindrical body and a second end that is open and the second end has a thickness that tapers, the extension also has an outer diameter that is less than an outer diameter of the cylindrical body, forming a sloped shoulder therebetween;

wherein the cylindrical body is adapted to surround a barrel portion of a bat, adjacent a hitting zone of the bat, and the cylindrical body has an inner diameter corresponding to an outer diameter of the barrel to provide a friction fit therebetween, the friction fit enhanced by additional surface area provided by the plurality of angled ribs disposed within the bore of the cylindrical body.

14. The apparatus of claim 1, wherein the cylindrical body has an inner diameter corresponding to an outer diameter of the barrel to provide a friction fit therebetween.

15. The apparatus of claim 1, wherein the annular sleeve has a first end connected to the cylindrical body and a second end that is open, and wherein the second end has a thickness that tapers.

* * * * *